United States Patent [19]

Treiber et al.

[11] 4,364,890

[45] Dec. 21, 1982

[54] PROCEDURE FOR THE PREPARATION OF CRIMPED HIGH-WET-MODULUS STAPLE FIBRES

[75] Inventors: Erich E. Treiber, Lidingö; Dag E. Ehrengård, Stockholm; Owe S. Lidbrandt, Sollentuna, all of Sweden

[73] Assignee: Svenska Rayon AB, Valberg, Sweden

[21] Appl. No.: 199,464

[22] PCT Filed: Nov. 14, 1979

[86] PCT No.: PCT/SE79/00235

§ 371 Date: Jul. 14, 1980

§ 102(e) Date: Jul. 9, 1980

[87] PCT Pub. No.: WO80/00979

PCT Pub. Date: May 15, 1980

[30] Foreign Application Priority Data

Nov. 14, 1978 [SE] Sweden ..... 7811741

[51] Int. Cl.[3] ..... D01F 2/08

[52] U.S. Cl. ..... 264/191; 106/165; 106/176; 264/194

[58] Field of Search ..... 264/191, 193, 194, 188; 106/165, 176

[56] References Cited

U.S. PATENT DOCUMENTS

| | | | |
|---|---|---|---|
| 2,860,480 | 11/1958 | Cox | 264/194 |
| 2,910,341 | 10/1959 | Cox et al. | 264/194 |
| 2,948,582 | 8/1960 | Haley | 264/194 |
| 3,063,789 | 11/1962 | Dooley | 264/194 |
| 3,112,986 | 12/1963 | Woodell | 264/194 |
| 3,657,410 | 4/1972 | Sasakura et al. | 264/194 |

FOREIGN PATENT DOCUMENTS

| | | | |
|---|---|---|---|
| 1926506 | 1/1970 | Fed. Rep. of Germany . | |
| 2921314 | 12/1979 | Fed. Rep. of Germany | 264/191 |
| 37-9758 | 7/1962 | Japan | 264/188 |

*Primary Examiner*—Jay H. Woo

*Attorney, Agent, or Firm*—Toren, McGeady & Stanger

[57] ABSTRACT

The procedure provides for the manufacture of crimped high-wet-modulus staple fibres by spinning from viscose to which have been added small quantities of derivatives of cyclohexanone or cyclopentanone and/or alkylated amino compounds of cyclohexane or cyclopentane.

To improve the tenacity of the finished fibres, combinations of nitrogen-free and nitrogen-containing modifiers can be used. The viscose and/or spinning bath can also be treated with known stretching and spinning aids. In addition, the crimp-yielding additives can be combined with small amounts of zinc ions in the viscose, and the fibres can be allowed to relax in an alkaline bath after being spun.

8 Claims, No Drawings

PROCEDURE FOR THE PREPARATION OF CRIMPED HIGH-WET-MODULUS STAPLE FIBRES

This invention relates to a procedure for the preparation of crimped high-wet-modulus (HWM) staple fibres through the addition of alkylated compounds of cyclohexanone or cyclopentanone and/or polyalkylated and amino-group-bearing derivatives of cyclohexane or cyclopentane. The alkyl groups incorporated are preferably methyl or short-chain alkyl groups. These additives can, if desired, be combined with known modifiers for the improvement of strength properties and/or with small amounts of known additives which impart some degree of crimp when otherwise used in high concentrations. Known spinning techniques for the improvement of crimp can be applied without difficulty to fibres prepared according to this procedure.

HWM-fibres are viscose fibres which can replace cotton in a range of applications where it has not been possible to use the earlier rayon staple fibres. They are characterized by high dry and wet tenacity (greater than 3.0 and 2.2 cN/dtex respectively), low elongation (less than 17 and 20% respectively) and high wet modulus (greater than 80 cN/tex/100%). These properties give the finished fabric the necessary dimensional stability and open the way to a complete or partial replacement of cotton in cotton fabrics or mixed fabrics with polyester fibres, fabrics which can be boiled when washed.

HWM-fibres lack certain properties when compared with cotton. In comparison with 100% cotton, mixed yarns and fabrics of cotton-HWM or of polyester-HWM feel lean, i.e. they feel somewhat smooth and harsh and have a somewhat thin appearance (a poorer bulk or covering power). Textiles made solely of HWM-fibres do not feel the same as materials of 100% cotton. They do not have a true cotton feel. This is considered to be a serious disadvantage, even though it may be unimportant for the wear of the garment. It is known that this deficiency can be met by imparting crimp to the HWM-fibres, as a result of which the covering power of the fabric is increased and the garment feels more bulky, softer and more comfortable to wear. One way of imparting built-in crimp to an artificial fibre is to achieve an imbalance in the fibre cross-section, e.g. by spinning a two-component fibre. An easier method as far as rayon fibres are concerned is to make the thickness of the skin uneven around the core and to take advantage of the difference in contraction tendency of the skin and core layers. High crimp, i.e. more than 4 (preferably more than 6) waves/cm, can be achieved in HWM-fibres through (a) an accurate adjustment of viscose properties, particularly the degree of ripening and the spinning conditions, (b) the formation and stretching of hydroxymethyl cellulose xanthate and possibly relaxation in weakly alkaline solution, (c) the addition of sodium zincate (1–6% Zn on the basis of the weight of cellulose) to the viscose from which the fibres are subsequently spun, (d) the addition of polyacrylamide or similar derivatives (1–15% on the basis of weight of cellulose).

This invention is based on the observation that the addition of cyclic aliphatic compounds, particularly derivatives of cyclohexanone, e.g. 3,3,5-trimethylcyclohexanone (TMC-one), or of cyclopentane or cyclohexane, e.g. 1-amino-2-aminomethyl-3,3,5-trimethylcyclopentane(TMC-PD), 3,3,5-trimethylcyclohexylamine (TMC-amine), 1-hydroxy-3-aminomethyl-3,5,5-trimethylcyclohexane (IPAA) and similar compounds, give both a modifier effect and crimp.

The use of unsubstituted cyclohexanone or cyclohexylamine derivatives as modifiers in super tyrecord spinning is known, but these agents give no crimp in this case. In contrast, it has been established that in the HWM-process cyclohexanone itself imparts a definite albeit small degree of crimp to HWM-fibres. The crimp effect increases with the addition of methyl groups to alkylated cyclohexanone. Thus, HWM-fibres with high tenacity and manifest crimp have been obtained (vide Example 1) by the addition of 0.8% TMC-amine or TMC-one (calculated with reference to the weight of cellulose) instead of the modifiers of the polyethylene glycol or amine type (polyoxyethylene glycol derivatives, alkylaminpolyoxyethylene glycol or simple amines such as dimethylamine) usually used in the preparation of high-wet-modulus fibres spun according to the modifier process.

A further increase in the crimp of HWM-fibres can be achieved through the addition of small amounts of known substances such as bivalent metal ions or suitable synthetic water-soluble polymers such as polyacrylamide or through a suitabel spinning technique, e.g. the relaxation of the fibre in an alkaline bath (vide Example 4). In this way, the quantity of additives can in general be kept smaller than would otherwise be necessary to achieve crimp, which provides not only technical and economic advantages but also environmental ones. Known modifiers, stretch aids such as hexanol, formaldehyde etc and surface active spinning aids (e.g. laurylpyridinium chloride or cetylmethylammonium chloride) can be added without disadvantage.

The invention is illustrated by the following examples:

EXAMPLE 1

From an alkali cellulose to which 0.25% (on the basis of weight of cellulose) of a polyoxyethylene glycol derivative of an aromatic compound has been added, a xanthate is prepared with a charge of 37.5% carbon disulphide. The xanthate is dissolved at low temperature to give a viscose containing 7% cellulose and 7% sodium hydroxide. In accordance with the invention, 0.8% TMC-one or TMC-amine (calculated with respect to the weight of cellulose) is added to the viscose.

The viscose is spun at a $\gamma$-number less than 50 in a spinning bath containing 75 g/l $H_2SO_4$, 100 g/l $Na_2SO_4$ and 55 g/l $ZnSO_4$ and a spinning aid. The temperature of the bath is maintained at about 32° C. and the draw rate is 12.8 m/min. The thread is then stretched $\geqq 110\%$ at $\geqq 96°$ C. in a stretching bath containing 12 g/l $H_2SO_4$, 4 g/l $Na_2SO_4$ and $\leqq 0.5$ g/l $ZnSO_4$.

The resulting fibres are cut and relaxed in water at a temperature $\geqq 85°$ C. containing 12 g/l $H_2SO_4$. Desulphurization takes place in a bath containing 2 g/l $Na_2S$, 3 g/l $Na_2SO_3$ and 6 g/l NaOH. The properties of the resulting fibres are presented in the following table:

| Modifier | titre dtex | tenacity cN/dtex cond | tenacity cN/dtex wet | elongation % cond | elongation % wet | wet modulus cN/tex/100% | crimp number waves/cm | crimp degree % |
|---|---|---|---|---|---|---|---|---|
| TMC-amine | 1.76 | 3.6 | 2.5 | 15.0 | 15.6 | 101 | 4.6 | 6 |
| TMC-one | 1.61 | 3.9 | 2.5 | 13.8 | 13.9 | 123 | 4.5 | 5 |

EXAMPLE 2

An alkali cellulose as in example 1 is xanthogenated with 36% $CS_2$ and dissolved to viscose containing 7.2% cellulose and 7.0% NaOH. As a modifier, 0.05% polyethylene glycol (PEG 1550) is added, and in accordance with the invention 0.8% IPAA and 0.2% TMC-PD (cyclopentane).

Spinning, stretching and subsequent treatment is carried out as in example 1 with a draw rate of 15 m/min and a hot-stretch ≧120%. The following results are obtained:

| titre dtex | tenacity cN/dtex cond | tenacity cN/dtex wet | elongation % cond | elongation % wet | wet modulus cN/tex/100% | crimp number waves/cm | crimp degree % |
|---|---|---|---|---|---|---|---|
| 1.98 | 3.5 | 2.7 | 19 | 20 | 82 | 5 | 6 |

EXAMPLE 3

To a viscose containing 7.2% cellulose, 7.0% NaOH and 36% $CS_2$, 0.5% polyethylene glycol and 1% TMC-one (calculated with reference to the cellulose) are added. In addition, 0.1% triethanolamine or EDTA and 0.3% polyacrylamide are added. As a stretch aid, 2 g hexanol/kg viscose is added.

Spinning is carried out in a spinning bath containing 63 g/l $H_2SO_4$, 176 g/l $Na_2SO_4$, 37 g/l $ZnSO_4$ and a spinning aid, e.g. 1 g/l laurylpyridinium chloride. The draw rate is 15 m/min and the hot-stretch ≧120%. Fibres with a high degree of crimp are obtained (crimp number ≧6.1 waves/cm. crimp degree ≧8%).

EXAMPLE 4

To a viscose containing 7.2% cellulose, 7.0% NaOH, 36% $CS_2$, 0.5% polyethylene glycol and 0.4% dimethylamine, 1% TMC-one and ≦0.1% Zn ions are added. Spinning is carried out as in example 3, but guide bars are arranged in the spinning bath in order to delay "jet-stretch" in the filaments. After stretching, the thread is relaxes in an alkaline bath of e.g. the following constitution: 40 g/l $MgSO_4.7H_2O$, 20 g/l $(NH_4)_2SO_4$ and 10 g/l $NH_4OH$ (25%), and at a temperature of 50° C.

A very high degree is achieved (crimp number ≧9 waves/cm, crimp degree ≧15%).

EXAMPLE 5

To a viscose containing 7.2% cellulose, 7.0% NaOH, 36% $CS_2$ and 0.6% polyoxyethylene glycol, are added 1.0% TMC-one, 0.5% cyclohexanone, 0.5% methylcyclohexylamine, or IPAA, or TMC-PD (all calculated on the basis of the weight of cellulose in the viscose) and 0.5% $Zn^{2+}$. The spin-γ lies between 38 and 40. Spinning is carried out as in example 3 or 4. The fibres have a tenacity of ≧3.3 cond. and ≧2.4 cN/dtex wet respectively, an elongation of 13 and 15% respectively and a wet modulus of 98 cN/tex/100%. The crimp number is 8 waves/cm and the crimp degree is 13%.

EXAMPLE 6

A viscose with a basic composition of 7.2/7.0/36 corresponding to the one in example 3 contains the following modifiers, calculated with reference to the cellulose in the viscose:

1% TMC-one
0.2% N-cyclohexyl-1,3-propylamine
0.4% 3-isonyloxypropylamine
0.2% glyco 1540(polyoxyethylene glycol)
0.1% EDTA The viscose is spun to a γ-number 40 in a spinning bath containing 63 g/l $H_2SO_4$, 180 g/l $Na_2SO_4$, 37 g/l $ZnSO_4$, 1 g/l glyoxal, 0.5 g/l LPC. The thread is stretched 120% resulting in the following textile properties:

| tenacity p/dtex cond | tenacity p/dtex wet | elongation % cond | elongation % wet | wet modulus cN/tex/100% | crimp number waves/cm | crimp degree % |
|---|---|---|---|---|---|---|
| 3.5 | 2.4 | 14 | 16 | 95 | 8 | 10.5 |

EXAMPLE 7

A viscose with a basic composition of 7.2/7.0/36 corresponding to the one in example 3 contains the following modifiers, calculated with reference to the cellulose in the viscose:

1% TMC-one or TCMP-one
0.2% cyclohexanone
0.3% Polyoxyethylene or polypropylene glycol (e.g. Berol Visco 399)
0.5% 3-isononyloxypropylamine
0.1% cetyltrimethylammonium chloride as a spinning aid The viscose is spun to a γ-number >40 in a spinning bath containing 65 g/l $H_2SO_4$, 180 g/l $Na_2SO_4$, 37 g/l $ZnSo_4$ and balancing concentrations of the modifier of the viscose. The thread is stretched 120% resulting in the following textile properties:

| tenacity p/dtex cond | tenacity p/dtex wet | elongation % cond | elongation % wet | wet modulus cN/tex/100% | crimp number waves/cm | crimp degree % |
|---|---|---|---|---|---|---|
| 3.3 | 2.3 | 15 | 17 | 84 | 7 | 11 |

EXAMPLE 8

To the alkali cellulose is added during the grating 0.3% of an aromatic amino polyglycol ether (e.g. Berol Visco 34). After preripening the alkali cellulose is xanthogenated with 36.5% $CS_2$ and the xanthate is dissolved in a viscose containing 7.2% cellulose and 7.0% NaOH. To the viscose are added 0.2% hexanol as a stretch aid, 0.25% of a polyoxyethylene derivate (e.g. Berol Visco 399) and 0.40% methylcyclohexamine or dicyclohexylamine. 1% cyclohexanone is used as a crimp modifier.

The viscose is spun to a γ-number 37 in a spinning bath containing 63 g/l $H_2SO_4$, 178 g/l $Na_2SO_4$, 37 g/l $ZnSO_4$, 1 g/l LPC and 0.3 g/l polyoxyethylene glycol (e.g. Berol Visco 311) at 36° C. The stretch is 120% at 96° C. The following textile properties are obtained:

| tenacity p/dtex | | elongation % | | wet modulus | crimp number | crimp degree |
|---|---|---|---|---|---|---|
| cond | wet | cond | wet | p/tex/100% | waves/cm | % |
| 3.2 | 2.0 | 16 | 19 | 70 | 6.2 | 10 |

We claim:

1. In a process for the production of crimped high-wet-modulus staple fibers wherein fibers are spun from an unripe cellulose viscose, containing 7–8% cellulose, 6.8–7.5% sodium hydroxide, 35–38% carbon disulphide and one or more metal-ion-free, organic modifiers, the improvement which comprises adding to said viscose after xanthation has been completed, but prior to spinning, a substance, selected from the group consisting of unsubstituted compounds of cyclohexanone or cyclopentanone, methylated compounds of cyclohexanone or cyclopentanone, polyalcylated monoamino compounds of cyclohexane or cyclopentane in an amount in the range from about 0.3% to 5% based on the amount of cellulose in the viscose, the fibers being spun at gamma number of <50 and a salt index of <5 in a coagulation bath of 30°–40° C. temperature containing 60–80 grams sulphuric acid, 100–180 grams sodium sulphate and 30–55 grams zinc sulphate, all calculated per liters, and stretched 110–120% in an acid bath with a temperature of 90°–100° C.

2. The process of claim 1 wherein the amount of said added compound is from about 0.5% to 3%.

3. The process of claim 1 or 2 wherein nitrogen-free modifiers are present in the viscose.

4. The process of claim 1 or 2 wherein the viscose also contains known spinning aids.

5. The process of claim 1 or 2 wherein the viscose also contains known stretching aids.

6. The process of claim 1 or 2 wherein zinc ions are added to the viscose.

7. The process of claim 1 or 2 wherein EDTA are added to the viscose.

8. The process of claim 1 or 2 wherein the fibres are prestretched in a secondary bath and then allowed to relax in an alkaline bath at a temperature greater than about 40° C.

* * * * *